US006304731B1

(12) United States Patent
Able et al.

(10) Patent No.: US 6,304,731 B1
(45) Date of Patent: Oct. 16, 2001

(54) PRINTER FOR NARROW MEDIA

(75) Inventors: Douglas Anthony Able, Shelbyville; Charles Jerome Cheek, Versailles; Cyrus Bradford Clarke; James Douglas Gilmore, both of Lexington; Douglas Campbell Hamilton; Thomas Campbell Wade, both of Lexington, all of KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/590,574

(22) Filed: Jun. 8, 2000

(51) Int. Cl.[7] ..... G03G 15/00; G03G 15/20

(52) U.S. Cl. ..... 399/45; 399/67; 399/68; 399/69

(58) Field of Search ..... 399/67–69, 43, 399/45, 329, 400, 330, 334; 219/216

(56) References Cited

U.S. PATENT DOCUMENTS

| | | | | |
|---|---|---|---|---|
| 4,549,803 | | 10/1985 | Ohno et al. . | |
| 4,634,262 | | 1/1987 | Imaizumi et al. . | |
| 4,825,242 | | 4/1989 | Elter . | |
| 5,289,247 | * | 2/1994 | Takano et al. | 399/68 |
| 5,325,166 | | 6/1994 | Hamilton et al. . | |
| 5,374,947 | | 12/1994 | Takahaski et al. . | |
| 5,552,874 | | 9/1996 | Ohtsuka et al. . | |
| 5,678,160 | * | 10/1997 | Williams | 399/400 |
| 5,689,760 | | 11/1997 | Suzuki et al. . | |
| 5,860,051 | | 1/1999 | Goto et al. . | |
| 5,877,798 | | 3/1999 | Clarke et al. . | |
| 6,021,284 | * | 2/2000 | Serizawa et al. . | |
| 6,108,500 | * | 8/2000 | Ohkama et al. | 399/67 |
| 6,115,563 | * | 9/2000 | Miyamoto | 399/67 |
| 6,185,389 | * | 2/2001 | Bartley et al. | 399/69 |

FOREIGN PATENT DOCUMENTS

| | | | |
|---|---|---|---|
| 2-132481 | * | 5/1990 | (JP) . |
| 2-275483 | * | 11/1990 | (JP) . |
| 3-18883 | * | 1/1991 | (JP) . |
| 3-163464 | * | 7/1991 | (JP) . |
| 4-178677 | * | 6/1992 | (JP) . |
| 6-186875 | * | 7/1994 | (JP) . |
| 7-199694 | * | 8/1995 | (JP) . |
| 8-220928 | * | 8/1996 | (JP) . |
| 11-133790 | * | 5/1999 | (JP) . |

* cited by examiner

*Primary Examiner*—Susan S. Y. Lee
(74) *Attorney, Agent, or Firm*—John A. Brady

(57) ABSTRACT

A printer has a media feed path (12) for feeding sheets of media (14), with the path having a side reference edge (52) for aligning the media. A media transport mechanism feeds the sheets of media at a standard speed and at a reduced speed. A narrow media detector (38) generates a narrow media signal when sheets of narrow media are fed through the media feed path. A controller (68) adjusts the media transport mechanism to feed the narrow media aligned with the reference edge at the reduced speed. A method of printing sheets of narrow media in a printer comprises the steps of aligning the narrow media with a reference edge in a media feed path of the printer, sensing when the narrow media are present in the media feed path, and feeding the narrow media through the media feed path at the reduced sheet feeding speed and, particularly with a belt fuser, with increased inter-sheet gap.

8 Claims, 10 Drawing Sheets

PRINTER FOR NARROW MEDIA

FIELD OF THE INVENTION

This invention relates to an electrophotographic printer, and more particularly, to a laser printer for printing narrow media with high throughput that does not overheat the fuser.

BACKGROUND OF THE INVENTION

An electrophotographic printer prints an image on media, such as sheets of paper, from toner contained in a toner cartridge. A developer roller or sleeve is mounted within the toner cartridge in proximity to a photoconductive drum. The photoconductive drum is charged, and a laser scans the charged photoconductive drum with a laser beam to discharge the surface and form a latent image thereon. The developer roller attracts statically charged toner from the toner container. Toner is transferred from the developer roller to the photoconductive drum to develop the latent image formed on the photoconductive drum. The developed image is then transferred to statically charged sheets of media. The sheets are fed through a heated fuser assembly, where the heat fixes the visible image.

Sheets of narrow media, such as envelopes, are aligned with a reference edge in the feed path of the printer. Because the narrow sheets do not extend across the full width of the feed path, the consecutive printing of several sheets of narrow media creates a temperature imbalance in the fuser assembly. The sheets of media, when fed past the fuser assembly to fuse the image to the sheets, remove heat therefrom. Since sheets of narrow media do not extend fully across the width of the fuser assembly, the portion of the fuser assembly away from the reference edge, where the narrow media do not contact the fuser assembly, becomes hotter than the portion adjacent the reference edge, where the narrow media contact the fuser assembly. The fuser assembly can overheat so much after printing several consecutive sheets of narrow media that it becomes damaged.

One proposed solution to the problem of the overheating in a fuser assembly with a hot roller has been to make the fuser roller out of very thick material, so that the heat diffuses more evenly across the entire width. This has been unsatisfactory, as the cost of a thick fuser roller is high. This solution, of course, is not applicable to a fuser assembly with a fuser belt.

A second proposed solution to the problem of the overheating of the fuser assembly has been the insertion of gaps between the sheets of narrow media. Inter-sheet gaps permit the fuser assembly to equilibrate between sheets. However, this solution has also been unsatisfactory, as the insertion of inter-sheet gaps for all sheets of narrow media dramatically reduces the throughput of the printer.

A third proposed solution to the problem of the overheating of the fuser assembly has been to reduce the operating temperature of the fuser assembly and the transport speed. Consequently, all the sheets of media, regardless of width, are fed past the fuser assembly at a very slow speed, so that enough heat is transferred to the media to fuse the image thereto. However, this solution has also been unsatisfactory, as the slow feeding speed for all the sheets of media severely reduces the throughput of the printer.

SUMMARY OF THE INVENTION

A printer in accord with the present invention overcomes the foregoing problems by determining when narrow media are to be printed, aligning the narrow media with a side reference edge of the media path, lowering the temperature of the fuser assembly and feeding the narrow media through the media path at a reduced speed, and, for certain conditions, increasing the gap between fed sheets.

In accord with one aspect of the present invention, a printer comprises a media feed path for feeding sheets of media through the printer, the path including a side reference edge, and a media transport mechanism for feeding the sheets of media at a standard speed and at a reduced speed along the media feed path. A narrow media detector generates a narrow media signal when sheets of narrow media are fed through the media feed path. A controller responds to the narrow media signal and adjusts the media transport mechanism to feed the narrow media aligned with the reference edge at the reduced speed.

In accord with another aspect of the present invention, a printer system comprises a media feed path for feeding sheets of media through the printer, the path including a reference edge, and a media transport mechanism for feeding the sheets of media at a standard speed and at a reduced speed along the media feed path. A narrow media detector generates a narrow media signal when sheets of narrow media are fed through the media feed path. A programmed microcomputer responds to the narrow media signal and adjusts the media transport mechanism to feed the narrow media aligned with the reference edge at the reduced speed.

An advantage of a printer in accord with this invention is that sheets of narrow media are printed without damaging the printer even though use of a side reference edge adds to heat stress at the fixing mechanism when fixing narrow media.

Another advantage of a printer in accord with this invention is that sheets of narrow media are printed without overheating and damaging the fuser assembly.

A further advantage of a printer in accord with this invention is that narrow media are printed with a high printer throughput.

A still further advantage of the present invention is that it can be used in a printer with a fuser assembly having either a hot fuser roller or a fuser belt.

Other objects and advantages of the invention will be readily perceived from the following description, claims, and drawings.

BRIEF DESCRIPTION OF THE DRAWINGS

The attached drawings illustrate preferred embodiments of the invention, in which:

FIG. 5 is a flowchart illustrating programs used in the circuit of FIG. 4.

DETAILED DESCRIPTION OF PREFERRED EMBODIMENTS

Figure 1:
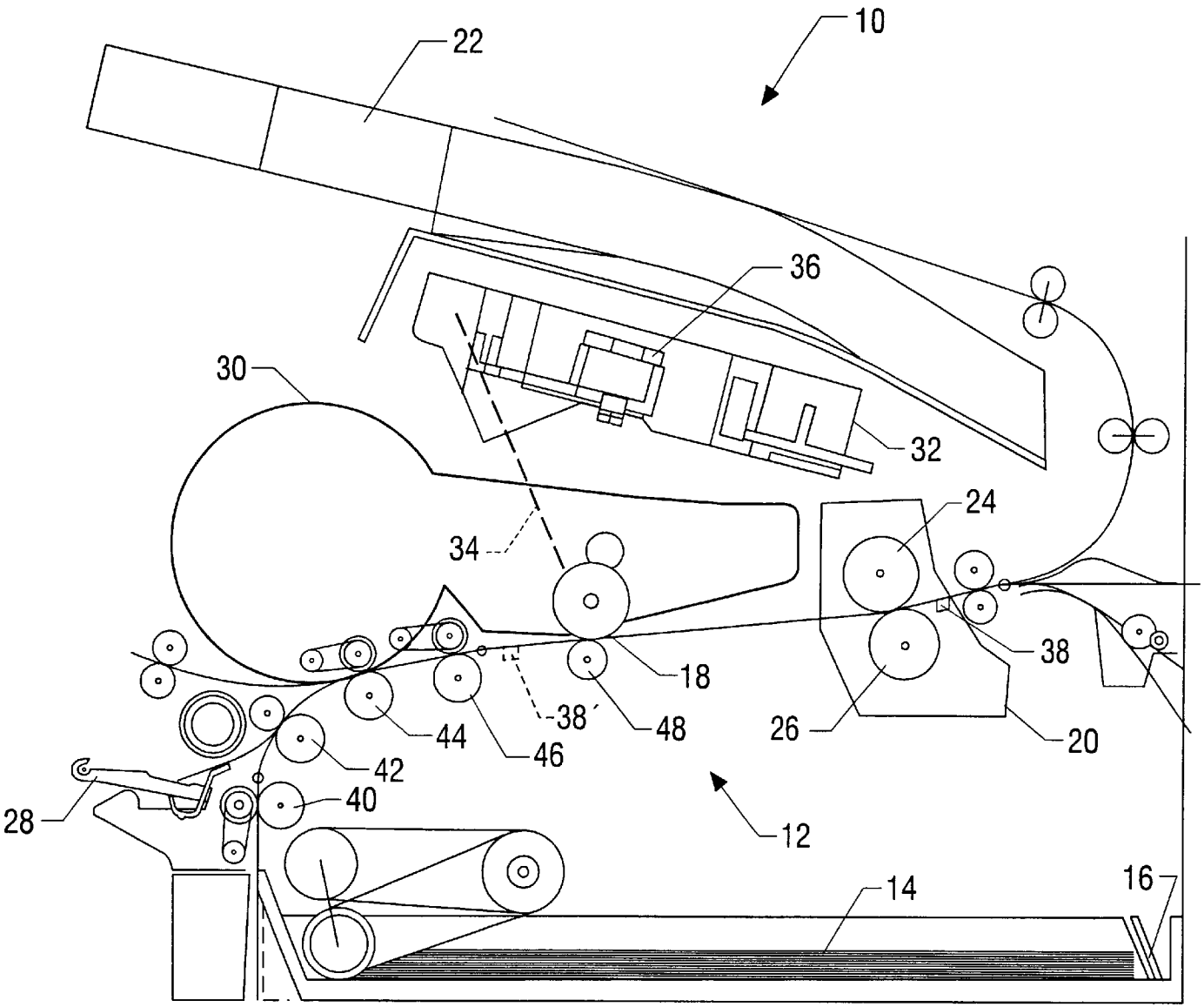
FIG. 1 is a cutaway, diagrammatic side view of an electrophotographic printer.
Figure 6:
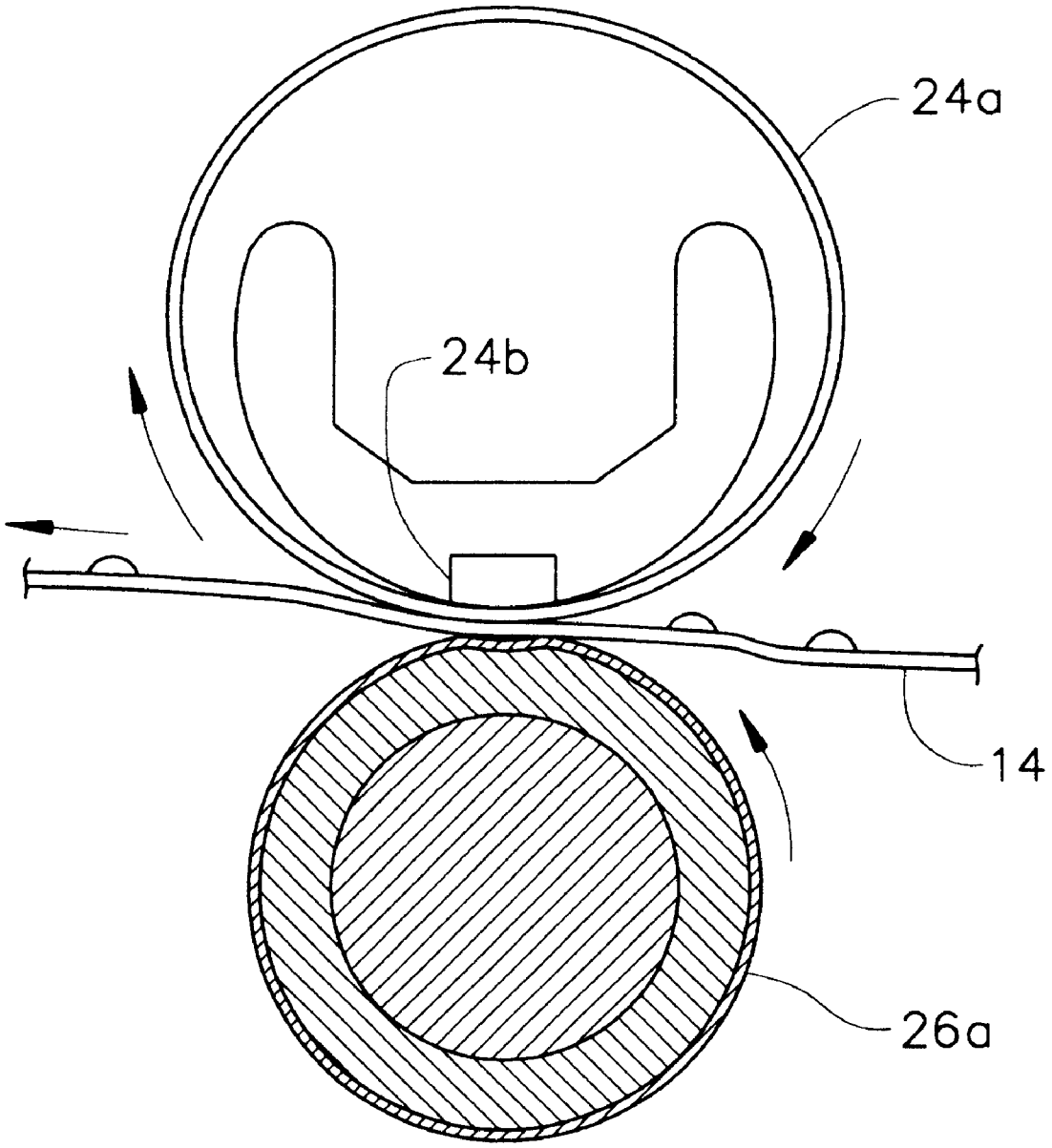
FIG. 6 is illustrative of a belt fuser.

Referring to the drawings, and initially to FIG. 1 thereof, an electrophotographic printer 10 includes a media feed path 12 for feeding sheets of media 14, such as paper, from a media tray 16 past a photoconductive drum 18 and a fuser assembly 20 to an output tray 22. The fuser assembly 20 may be a nip roller fuser formed by a fuser roller 24, which is heated to a relatively high temperature to fuse particles of toner to the sheets of media 14, a backup roller 26. U.S. Pat. No. 5,860,051 to Goto et al. is illustrative of a belt fuser. It will be appreciated that fuser assembly 20 could also be of the belt fuser type (see FIG. 6), in which a polyamide belt 24*a* passes over a ceramic heater 24*b* with the media 14 in a nip between belt 24*a* and a backup roller 26*a*. Special media, such as envelopes, transparencies or checks, are fed into the media feed path 12 from an external, front-option tray 28, sometimes referred to as a multi-purpose tray. Envelopes may also be fed from a separate, external tray (not shown). The photoconductive drum 18 forms an integral part of a replaceable toner cartridge 30 inserted in the printer 10. A printhead 32 is disposed in the printer 10 for scanning the photoconductive drum 18 with a laser beam 34 to form a latent image thereon. The laser beam 34 places a spot of light on a facet of a rotating polygonal mirror 36, which then redirects the laser beam 34 so that it ultimately sweeps of "scans" across a "writing line" on the photoconductive drum 18, thereby creating, in a black and white laser printer, a raster line of either black or white print elements, also known as "pels." The polygonal mirror 36 typically has six or eight facets, and each one-sixth or one-eighth rotation of the polygonal mirror 36, respectively, creates an entire swept raster scan of laser light that ultimately becomes a writing line on a sheet of media 14. The operation of the printhead 32 is more fully described in U.S. Pat. No. 5,877,798 to Clarke et al., also assigned to the assignee of the present application.

In the illustrated embodiment, the printer 10 has a narrow media sensor 38 located downstream, as viewed from the direction of flow of the media 14, from the photoconductive drum 18 and the fuser assembly 20. The narrow media sensor 38 detects the presence of sheets of narrow media in the media feed path 12. The narrow media sensor 38 could alternatively be located upstream from the photoconductive drum 18, as indicated in phantom 38'. A plurality of rollers 40, 42, 44, 46, 48 function in a known manner to transfer the sheets of media 14 from the media tray 16 or multi-purpose tray 28 through the media feed path 12.

Figure 2:
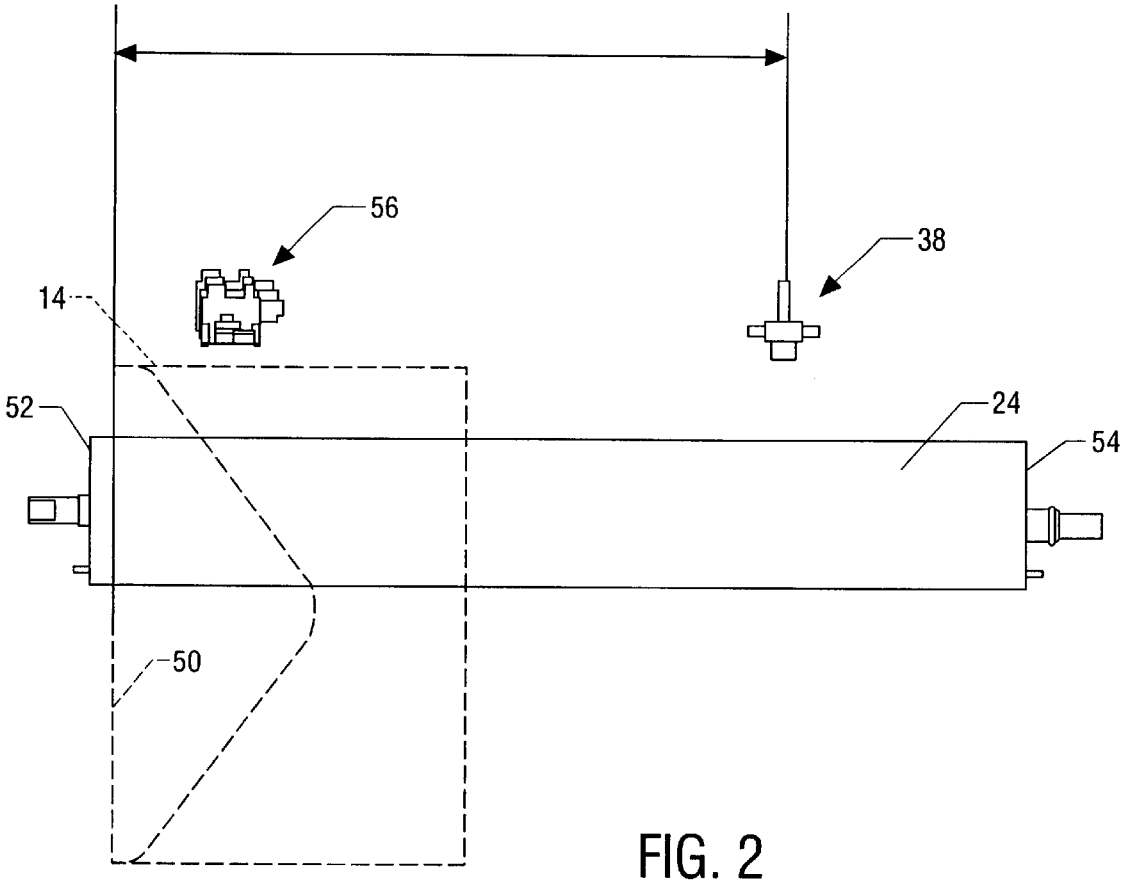
FIG. 2 is a diagrammatic plan view of a fuser roller in the printer of FIG. 1.

FIG. 2 illustrates the fuser roller 24 and a reference edge 50 of the media feed path 12. Sheets of narrow media 14, such as envelopes, shown in phantom on FIG. 2, are left justified and aligned with the reference edge 50 as they are fed through the media feed path 12. In one particular embodiment, the fuser roller 24 was slightly wider than 8½inches, so that it could accommodate full-width media, such as U.S. letter size paper and A4 paper. The narrow media sensor 38 was located between two edges 52, 54 of the fuser roller 24, at approximately three-quarters of the distance from the edge 52, corresponding to the lateral position of the reference edge 50, to the opposite edge 54 of the fuser roller 24. The narrow media sensor 38 can be located at different positions across the width of the media feed path 12. An exit sensor 56 is located adjacent the narrow media sensor 38 and detects the presence of any sheet of media 14 as it leaves the fuser assembly 20.

It will be appreciated that the printer 10 can print different widths of narrow media 14. In the preferred embodiment, the narrow media were classified into three categories, with each category having similar characteristics vis å vis the heating of the fuser assembly 20 when several sheets are consecutively printed. One category of narrow media is envelopes. A second category of narrow media is very narrow media. Very narrow media are media that the narrow media sensor 38 detects as narrow. Examples of very narrow media are A5 size paper and 3"×5" index cards. A third category of narrow media is nearly narrow media. Nearly narrow media are media that have a width between very narrow media and normal media. Nearly narrow media engage the narrow media sensor 38, but do not extend the full width of the fuser roller 24. Nearly narrow media are determined by the standard paper sizes detected within the paper tray 16. Examples of nearly narrow media are B5 size paper and executive size paper.

It will be recognized that other categories of media width for narrow media can be utilized with the present invention, with each category determined by the width of the media and the temperature characteristics of the fuser assembly 20 in printing them, and that the categories of media widths discussed hereinbefore are the preferred embodiment.

Figure 3:
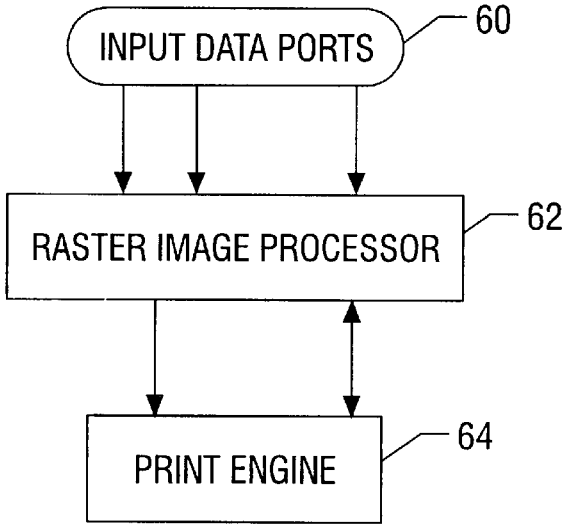
FIG. 3 is a schematic diagram of the data flow in the printer of FIG. 1.

Turning now to FIG. 3, a print job is sent to the printer 10 from a variety of sources, such as, for example, a networked personal computer running a word processing program, and is identified in the drawing as being supplied from input data ports 60. Each print job contains the image to be printed, and may contain additional information about the job, such as the media size and the media source. For example, a print job for an envelope may contain, in addition to the name and address to be printed, information indicating that the job is to be printed on a special size of media, i.e., an envelope. The media source information contained in the print job may specify which tray is to be used to supply the media to be printed.

A print job flows from the input data ports 60 to a raster image processor (RIP) 62, where the print job is rasterized to form a bitmap suitable for printing on the sheets of media 14. The bitmap from the raster image processor 62 is supplied to a print engine 64 for printing on the sheets of media 14. The RIP 62 supplements the job information contained in the print job received from the input data ports 60.

Figure 4:
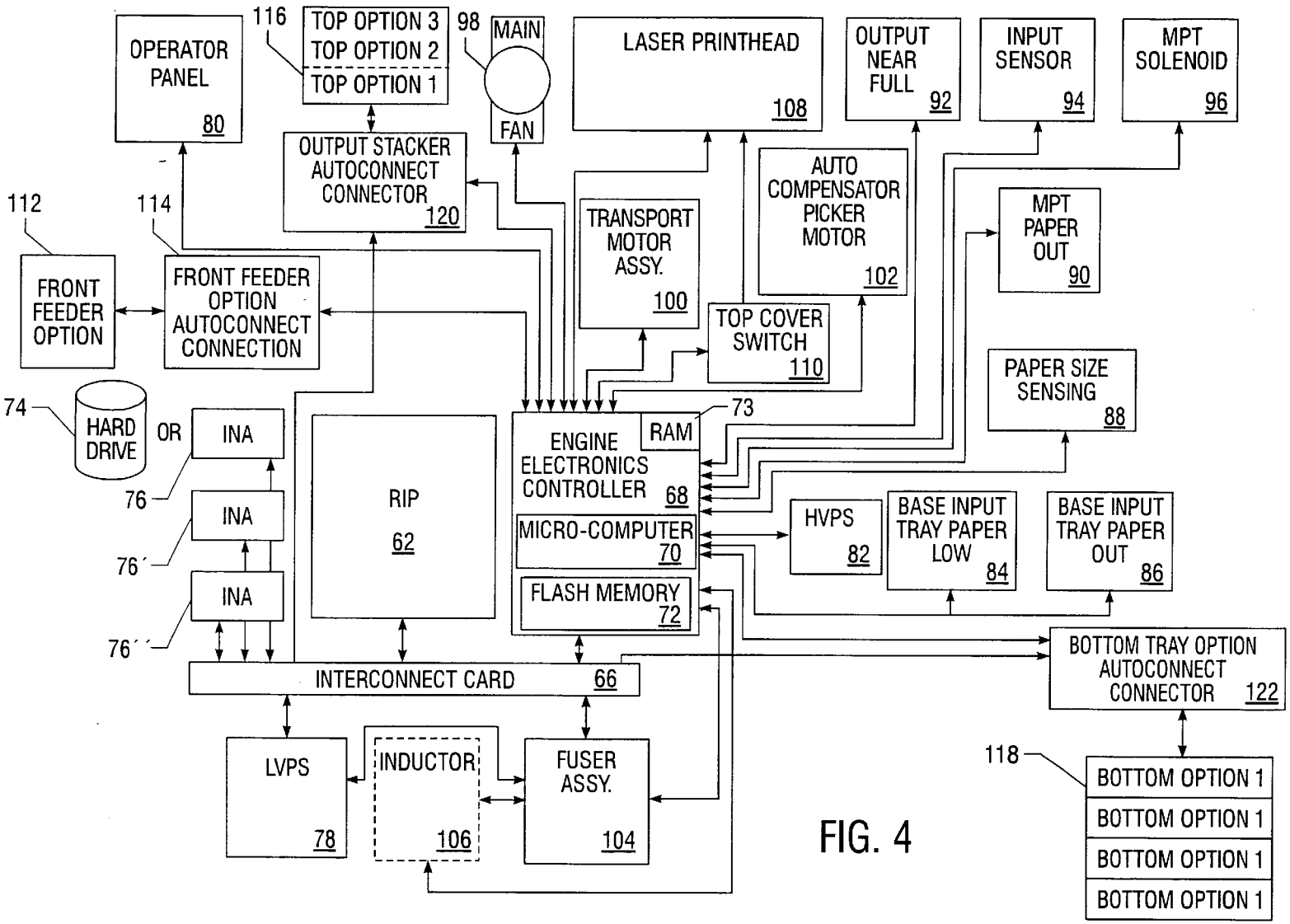
FIG. 4 is a block diagram of the electrical circuitry of the printer of FIG. 1.

Referring to FIG. 4, the raster image processor (RIP) 62 sends the bitmap through an interconnect card 66 to an engine controller 68. The engine controller 68 acts as a controller and data-manipulating device for the various hardware components within the print engine 64. The engine controller 68 includes a programmed microcomputer 70, a flash memory 72 and a random access memory (RAM) 73, for storing programs to be run thereon. In the preferred embodiment, the programmed microcomputer 70 was a Toshiba TMP90CM38 microcontroller. Other devices, such as a hard drive 74, can be connected to the RIP 62 via one of the integrated network adapters 76, 76', 76" and the interconnect card 66. A low voltage power supply (LVPS) 78 supplies the engine controller 68 and the RIP 62 with power via the interconnect card 66.

The engine controller 68 is connected to an operator panel 80, which is an input/output interface providing a user with a method to supply the printer 10 with configuration information. In one embodiment, the operator panel 80 was an LCD panel and input buttons. A user can use the operator panel 80 to supply the printer 10 with media information. The operator panel 80 can also display any of a large number of messages to the user, including status messages, e.g. ready/busy, output tray empty, output tray near full, output tray full, and error messages. The engine controller 68 is connected to a high voltage power supply (HVPS) 82, which supplies high voltages to hardware components, such as the photoconductive drum 18. A base input tray paper LED indicating a low paper condition 84, a base input tray paper LED indicating a no paper condition 86, a paper size sensor 88, a multifunction paper tray LED indicating a no paper condition 90, an output tray LED 92 indicating a near full output tray condition, an input sensor LED 94, which indicates that a sheet of media 14 is about to be printed, and a multipurpose tray (MPT) solenoid 96, which picks the sheets of media 14 out of the multipurpose tray 28, are connected to the engine controller 68. Additional components operated under control of the engine controller 68 include a main fan 98, a transport motor assembly 100, and an autocompensator picker motor 102. A fuser assembly 104, generally corresponding to the fuser assembly 20 of FIG. 1, operates under control of the engine controller 68. A fuser on/off signal passes from the engine controller 68 through the interconnect card 66 to the low voltage power supply (LVPS) 78. There, the on/off signal actuates a triac (not shown), thereby allowing AC current to flow into the fuser lamp or heater inside the fuser assembly 104 (depending on the type of fuser 104 employed in the printer 10). An inductor 106 is connected to the fuser assembly 104 and the engine controller 68. A laser printhead 108 is connected to the engine controller 68 and a top cover switch 110, which is also connected to the engine controller 68.

A front feeder option 112 is connected to the engine controller 68 through a front feeder option autoconnect connector 114. As noted hereinbefore, envelopes may be fed from the multi-purpose tray 28 (see FIG. 1), or from a separate tray associated with the front feeder option 112. The printer 10 has an optional output tray 116 and an optional input tray 118 with different options configurable under the control of a software program stored in the engine controller 68. The output and input trays 116, 118 are connected by an output stacker autoconnect connector 120 and a bottom tray option autoconnect connector 122, respectively, which provide electrical connections to the engine controller 68.

FIG. 5 depicts flowcharts for software programs or subroutines used in the engine controller 68, and which assist in the operation thereof. In one embodiment, software programs were written in a suitable computer language, such as C, and stored in the flash memory 72. As will be evident to those of ordinary skill in the art, the engine controller 68 could be replaced by an application specific integrated circuit (ASIC), which would operate as hereindescribed. Additionally, the software programs associated with FIG. 5 could be run on a server and connected to the printer through one of the integrated network adapters 76, 76', 76" of FIG. 3.

Figures 1, 5A:
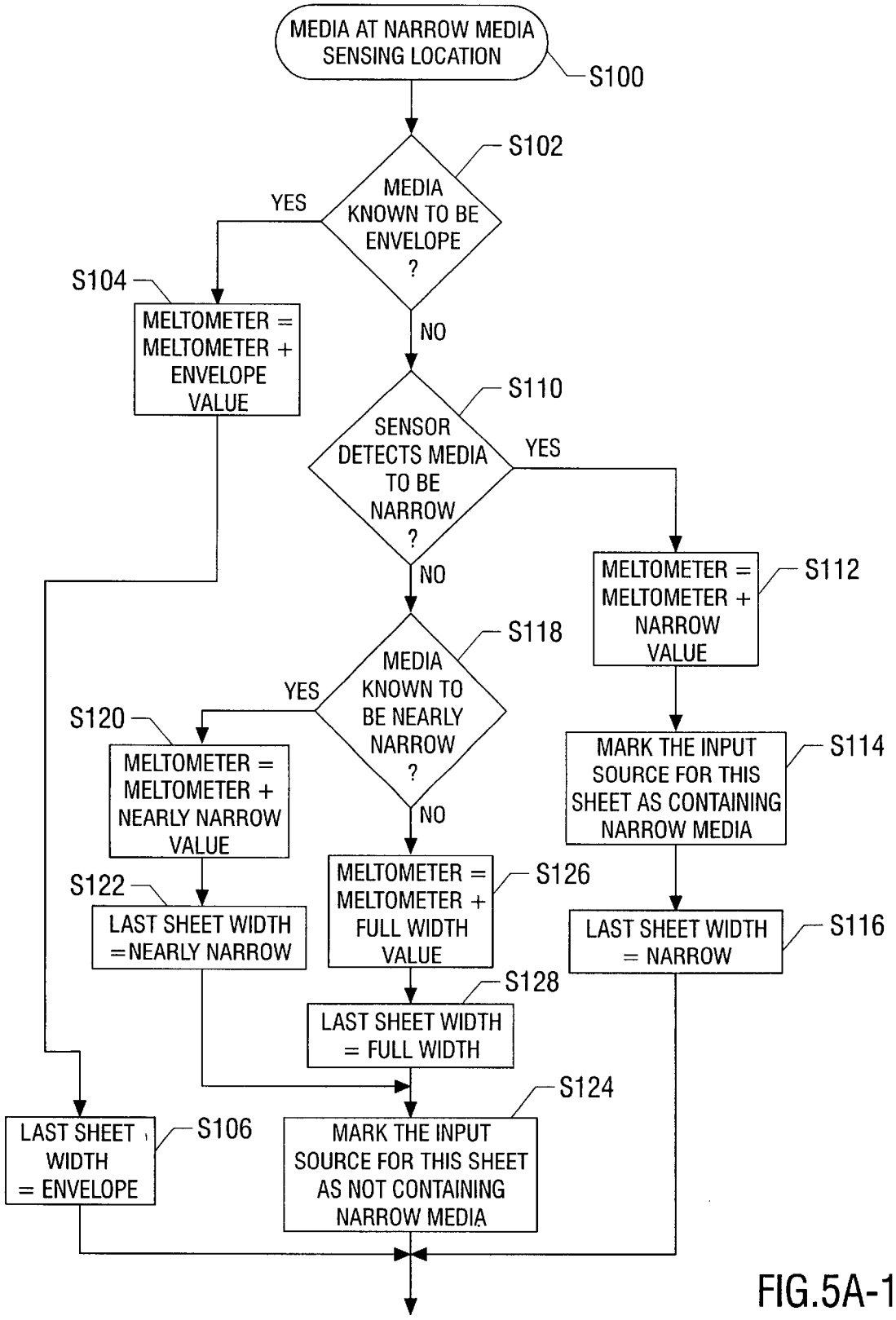
Figures 2, 5A:
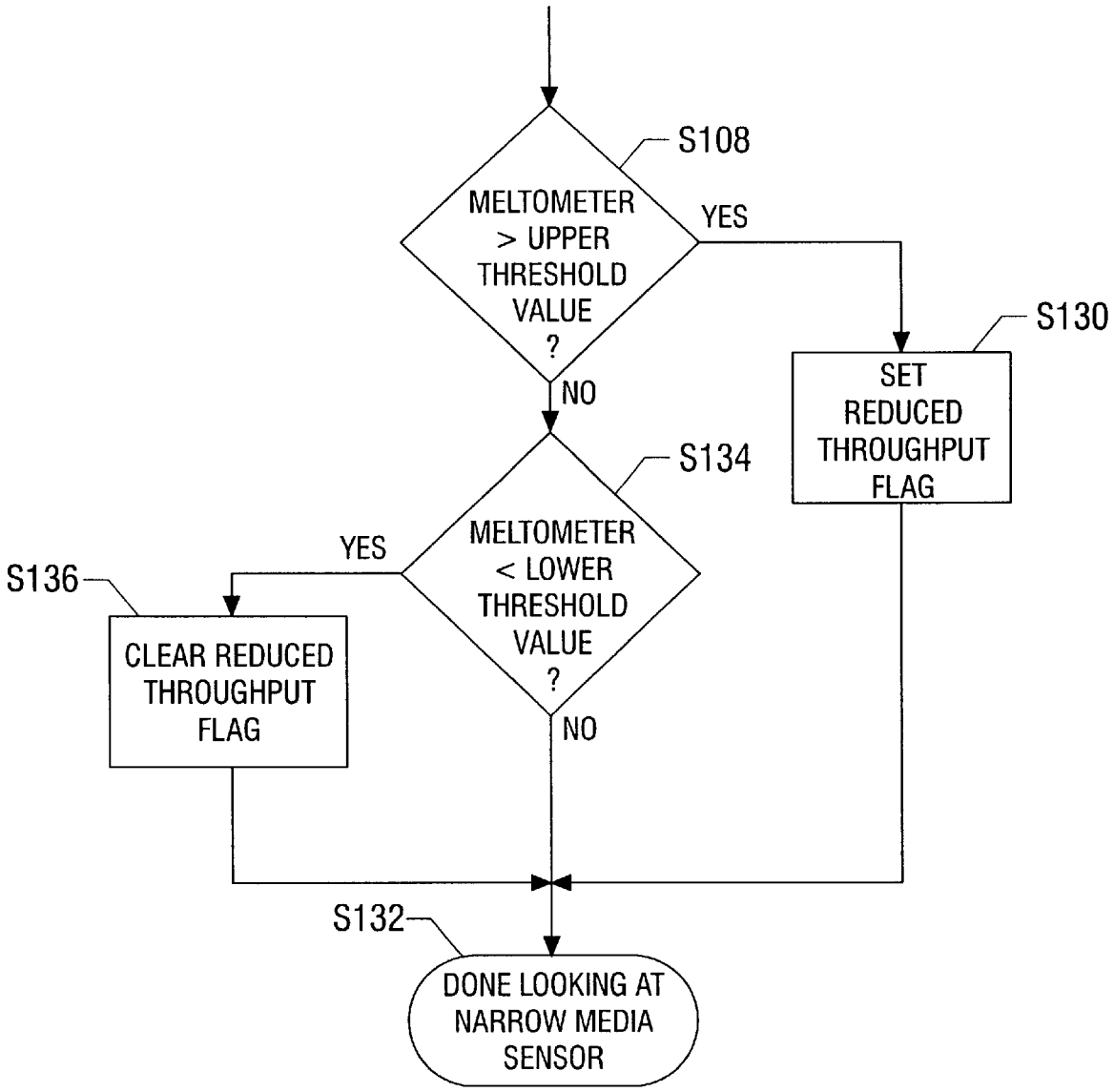

As shown on Figure 5A, the software program begins at step S100, which is associated with the condition when a sheet of media 14 is positioned in the media feed path 12 proximate the narrow media sensor 38. Program flow then continues at step S102, where the program determines whether the sheet of media 14 in the media feed path 12 is known to be an envelope. As discussed in connection with FIG. 3, the program does this by examining the information contained in the print job. If the program determines at step S102 that the sheet of media 14 is an envelope, program flow continues at step S104, where the program increments a count, commonly identified as a meltometer, by an amount corresponding to an envelope. Program flow then continues at step S106, where the program sets a flag corresponding to the condition where the last sheet width was an envelope. Program flow then continues at step S108.

As noted hereinbefore, the engine controller 68 maintains a count, called the meltometer, associated with the temperature of the fuser assembly 20. The meltometer is incremented or decremented according to the heat properties associated with each sheet of media 14 that the printer prints. When a sheet of media 14 is printed, it feeds past the heated fuser roller 24 (see FIG. 2), where the heat from the fuser roller 24 fuses the image to the sheet 14. In addition to fixing the image to the sheet 14, this operation removes heat from the fuser roller 24. Since sheets of narrow media, when aligned with the reference edge 50, do not extend fully across the width of the fuser roller 24, the portion of the fuser roller 24 away from the reference edge 50, where the narrow media do not contact the fuser roller 24, becomes hotter than the portion adjacent the reference edge 50, where the narrow media contact the fuser roller 24. The fuser roller 24 can overheat so much after printing several consecutive sheets of narrow media that it becomes damaged. Different widths of media remove different amounts of heat from the fuser assembly 20 when images are printed thereon, and the value of the meltometer is changed to reflect the sheets that have been printed on the printer 10, and hence, the temperature of the fuser assembly 20. It is to be appreciated that the value of the meltometer is not the actual temperature of the fuser assembly 20, but rather, a numeric representation of the approximate or projected value thereof. The changes in the value of the meltometer are related to the width of the sheets of media 14, as wider sheets of media 14 absorb greater amounts of heat from the fuser assembly 20 during the printing process, as discussed more fully hereinbelow.

If the program determines at step S102 that the sheet of media 14 is not an envelope, program flow continues at step S110, where the program interrogates the narrow media sensor 38 to determine whether the sheet of media 14 is very narrow, that is, whether it does not engage the narrow media sensor 38. If the program determines at step S110 that the sheet of media 14 is very narrow, program flow continues at step S112, where the program increments the meltometer by an amount corresponding to a sheet of very narrow media. Program flow continues at step S114, where the program stores a value to indicate that the input source for the sheet of media 14 is one that contains very narrow media. Program flow continues at step S116, where the program sets a flag to indicate that the last sheet width was a sheet of narrow media. Program flow continues at step S108.

If the program determines at step S110 that the sheet of media 14 is not very narrow media, program flow continues at step S118, where the program determines whether the sheet of media 14 is a sheet of nearly narrow media. As noted hereinbefore, nearly narrow media are media that have a width between very narrow media and normal media. If the program determines at step S118 that the sheet of media 14 is a sheet of nearly narrow media, program flow continues at step S120, where the program increments the meltometer by an amount corresponding to a sheet of nearly narrow media. Program flow continues at step S122, where the program sets a flag to indicate that the last sheet width was a sheet of nearly narrow media. Program flow continues at step S124, where the program stores a value to indicate that the input source for the sheet of media 14 is one that does not contain narrow media. Program flow continues at step S108.

If the program determines at step S118 that the sheet of media 14 is not nearly narrow media, program flow continues at step S126, where the program increments the meltometer by an amount corresponding to a sheet of full-width media. Program flow continues at step S128, where the program sets a flag to indicate that the last sheet width was a sheet of full-width media. Program flow continues at step S124, where the program stores a value in the RAM 73 to indicate that the input source for the sheet of media 14 is one that does not contain narrow media. Program flow continues at step S108.

At step S108, the program tests to determine whether the meltometer is greater than an upper threshold value. If the program determines that the meltometer is greater than the upper threshold value, program flow continues at step S130, where the program sets a reduced throughput flag, i.e., a value is stored in the RAM 73 to indicate that subsequent sheets of narrow media are to be fed through the media feed path 12 at a reduced rate. Program flow then continues at step S132, where the program has completed its task of looking at the input signals from the narrow media sensor 38.

If the program determines at step S108 that the value of the meltometer is not greater than the upper threshold value, program flow continues at step S134, where the program tests to determine whether the value of the meltometer is less than a lower threshold value. If the program determines at step S134 that the value of the meltometer is not less than the lower threshold value, program flow continues at step S132. If the program determines at step S134 that the value of the meltometer is less than the lower threshold value, program flow continues at step S136, where the program clears the reduced throughput flag. Program flow continues at step S132, where the program has completed its task of looking at the input signals from the narrow media sensor 38.

Figures 1, 5B:
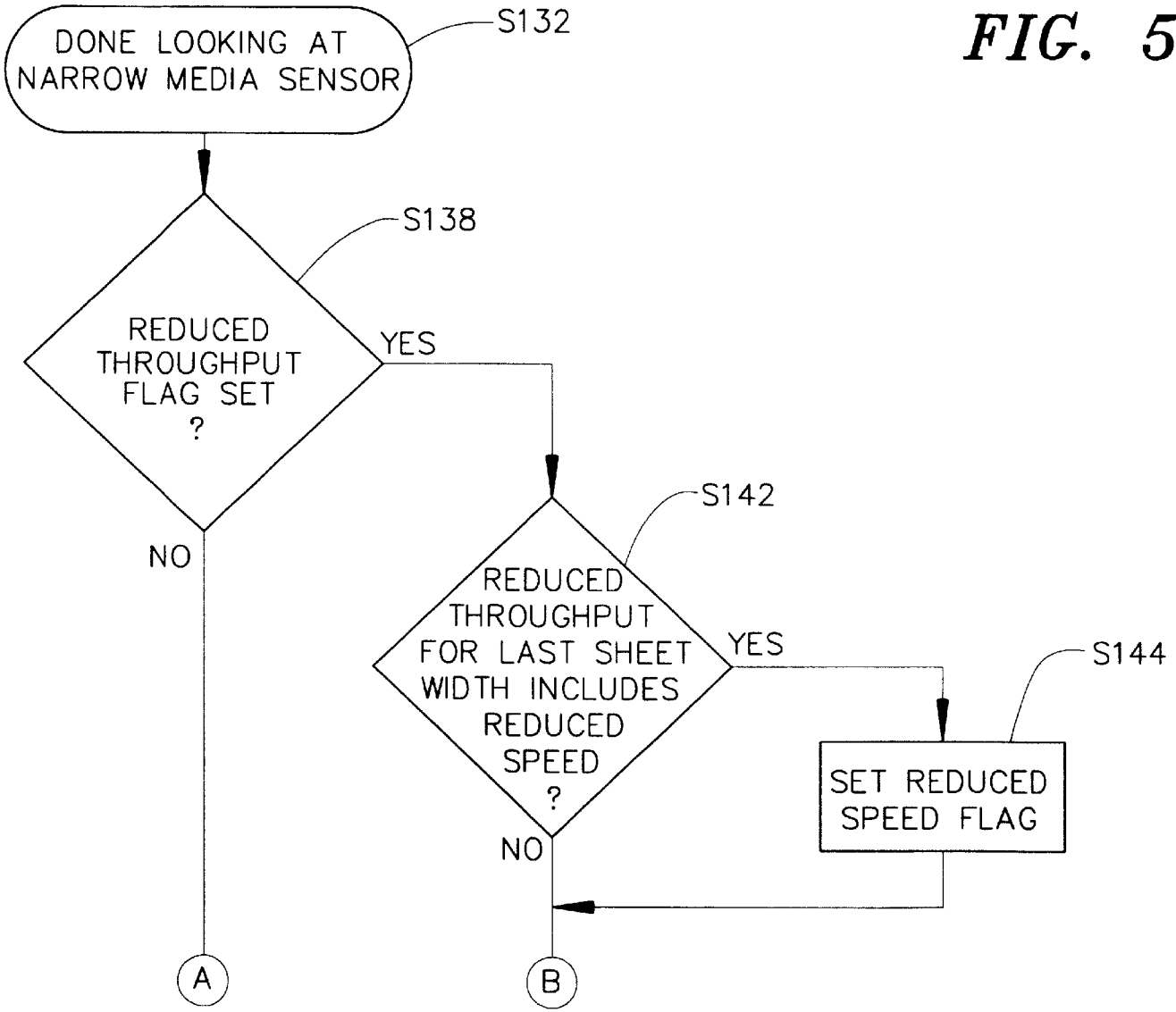
Figures 2, 5B:
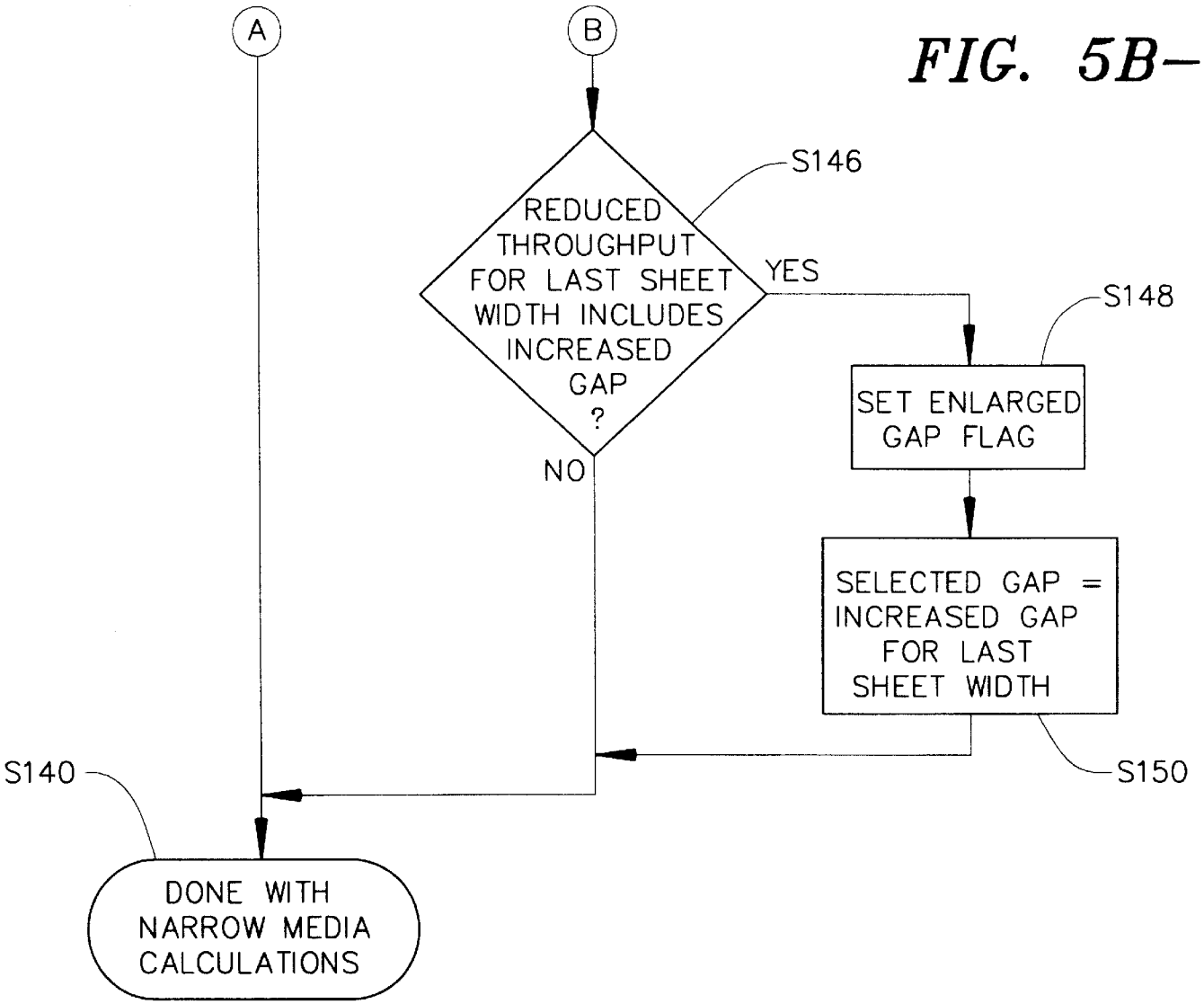

From step S132 on FIG. 5B, program flow continues at step S138, where the program tests to determine whether the reduced throughput flag has been set. If the program determines at step S138 that the reduced throughput flag has not been set, program flow continues a step S140, where the program determines that the narrow media calculations have been completed. If the program determines at step S138 that the reduced throughput flag has been set, program flow continues at step S142, where the program tests to determine whether the reduced throughput flag for the last sheet width should include a setting to indicate a reduced media sheet feeding speed. In a current embodiment, set reduced speed is done for all categories of narrow media except for nearly narrow media being printed in a nip-roller-fuser version of the highest speed printer (35 pages per minute). If the program determines at step S142 that the reduced throughput flag for the last sheet width should be set, program flow continues at step S144, where the program sets the reduced speed flag. Program flow continues at step S146.

If the program determines at step S142 that the reduced throughput flag for the last sheet width should not be set, program flow continues at step S146.

At step S146, the program tests to determine whether the reduced throughput for the last sheet width includes a larger inter-sheet gap. In a current embodiment, this set enlarged gap is not done for any narrow media with a nip roller fuser and is done for all categories of narrow media for a belt fuser (except for nearly narrow media with the nip-roller-fuser 35 ppm printer the gap is enlarged, but the speed is not reduced). If the program determines at step S146 that the reduced throughput for the last sheet width does not include a larger inter-sheet gap, program flow continues at step S140. If the program determines at step S146 that the reduced throughput for the last sheet width includes a larger inter-sheet gap, program flow continues at step S148, where the program sets the enlarged gap flag. Program flow continues at step S150, where the program sets a value indicating that the selected gap is an increased gap for the last sheet width. Program flow continues at step S140, where the program has completed the narrow media calculations.

It will be appreciated from the foregoing description that the present invention can be utilized with an enlarged inter-sheet gap to provide additional opportunities for the fuser assembly 20 to cool between consecutive sheets of narrow media.

Figures 1, 5C:
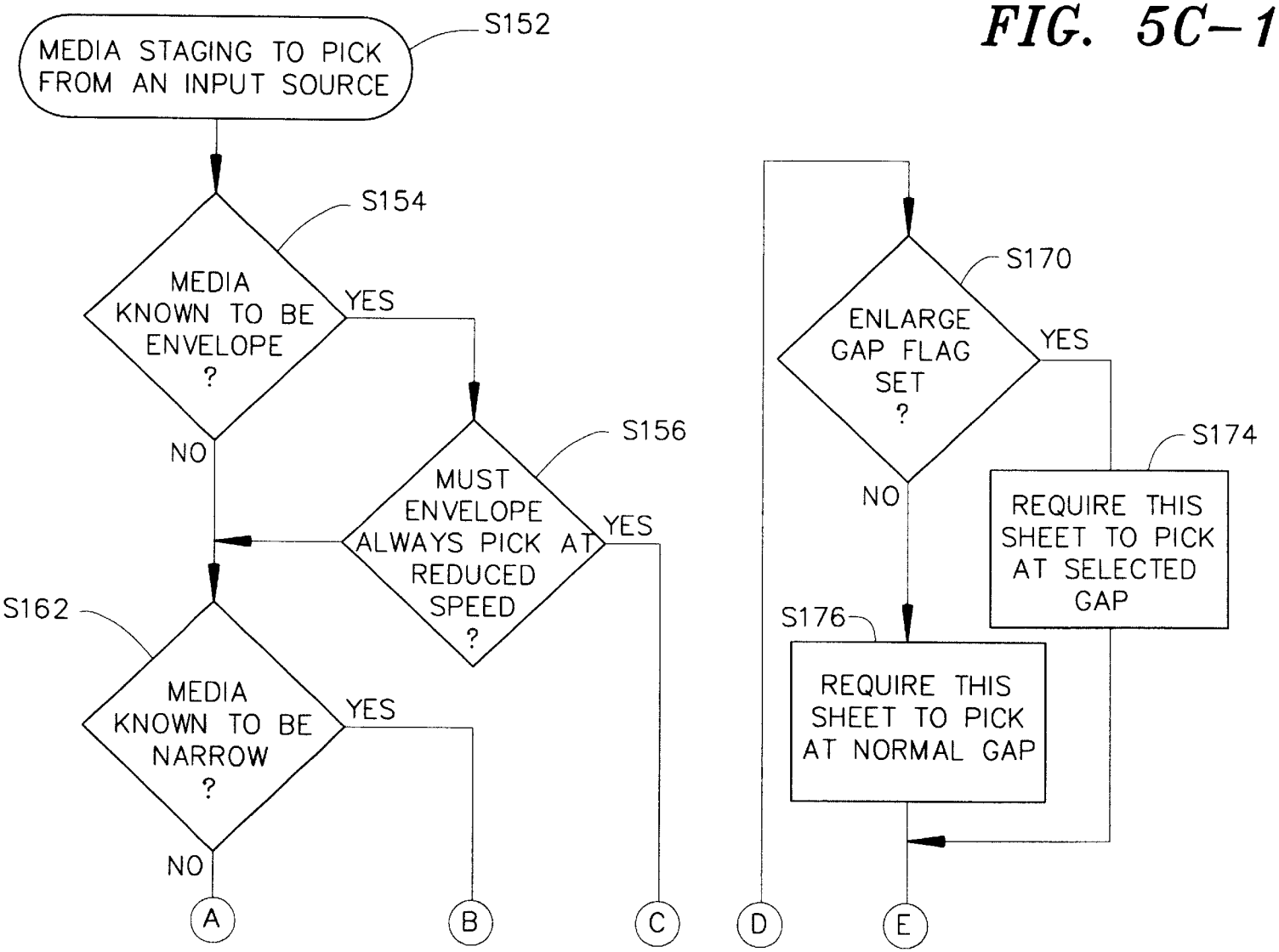
Figures 2, 5C:
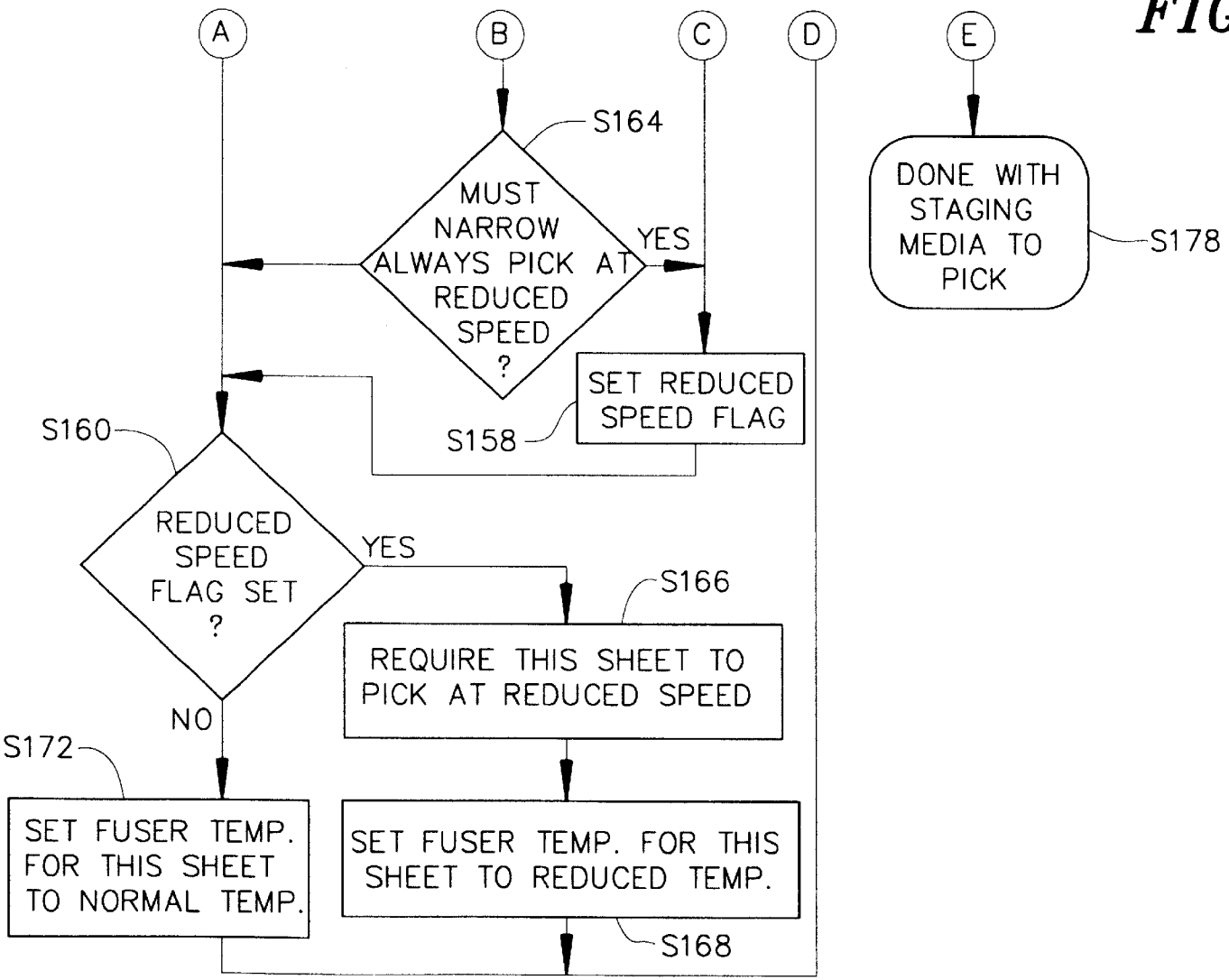

Turning now to FIG. 5C, program flow continues at step S152, where the sheet of media 14 is staged to be picked from an input source, such as a particular tray containing envelopes or other narrow media. At step S154, the program tests to determine whether the sheet of media 14 is known to be an envelope. If the program determines that the sheet of media 14 is an envelope, program flow continues at step S156, where the program tests to determine whether an envelope must always be picked and fed at a reduced speed. In a current embodiment, this is set to require reduced speed only when the fuser is a belt fuser. If the program determines at step S156 that an envelope must always be picked and fed at a reduced speed, program flow continues at step S158, where the reduced speed flag is set. Program flow continues at step S160.

If the program determines at step S156 that an envelope need not be picked and fed at a reduced speed, program flow continues at step S162, where the program tests to determine whether the sheet of media 14 is known to be very narrow media. If the program determines at step S162 that the sheet of media 14 is known to be very narrow media, program flow continues at step S164, where the program tests to determine whether sheets of very narrow media must always be picked and fed at a reduced speed. However, in a current embodiment, an envelope is the only category of narrow media which is picked and fed at a reduced speed. If the program determines at step S164 that sheets of very narrow media must always be picked and fed at a reduced speed, program flow continues at step S158, where the program sets the reduced speed flag. Program flow continues at step S160. If the program determines at step S164 that sheets of very narrow media are not always picked and fed at a reduced speed, program flow continues at step S160.

At step S160, the program tests to determine whether the reduced speed flag has been set. If the program determines at step S160 that the reduced speed flag has been set, program flow continues at step S166, where the program sets the printer to require the sheet of media 14 to be picked and fed at a reduced speed. Program flow continues at step S168, where the program sets the temperature of the fuser assembly 20 to a reduced temperature for the sheet of media 14. Program flow continues at step S170.

If the program determines at step S160 that the reduced speed flag has not been set, program flow continues at step S172, where the program sets the temperature of the fuser assembly 20 to a normal (or unreduced) temperature for the sheet of media 14. Program flow continues at step S170.

At step S170, the program tests to determine whether the enlarged inter-sheet gap flag has been set. If the program determines at step S170 that the enlarged inter-sheet gap flag has been set, program flow continues at step S174, where the program sets the printer 10 to require the sheet of media 14 to be picked and fed with the enlarged inter-sheet gap. Program flow continues at step S178, where the program has completed its operations with regard to staging the sheets of media 14 prior to the picking and feeding operation. Accordingly, with a belt fuser, the first envelopes are fed at a reduced speed and temperature, and subsequent envelopes are fed with increased gap by action of steps 148 in response to step S108 being "yes" when the amount of meltometer count is above the predetermined threshold value. In a current embodiment for the belt fuser, standard speed is 20 pages per minute (ppm), reduced speed is 10 ppm, and reduced speed with inter-sheet gap is 5 ppm.

If the program determines at step S170 that the enlarged inter-sheet gap flag has not been set, program flow continues at step S176, where the program sets the printer 10 to require the sheet of media 14 to be picked and fed at the normal inter-sheet gap. Program flow continues at step S178, where the program has completed its operations with regard to staging the sheets of media 14 prior to the picking and feeding operation.

It will be appreciated from the foregoing that the engine controller 68 has three sources of information about the width of a sheet of media 14 to be printed: the narrow media sensor 38, the information in the print job as it comes from the raster image processor 62, and historical data about the media source stored in the RAM 73. It will be further appreciated that the computer program of FIG. 5 utilizes information from the three sources in operating the printer 10. In the preferred embodiment, in the calculations performed above, the output from the narrow media sensor 38 overruled any information contained within the print job. In addition, in the calculations performed above, the printing of an envelope overruled any other categorization, such as very narrow media.

The primary benefit of reducing the speed at which the sheets of media 14 are fed through the media feed path 12 of the printer 10 is that, at a reduced speed, the operating temperature of the fuser assembly 20 can be reduced. The energy transferred from the fuser roller 24 to the sheet of media 14 is proportional to the fusing temperature and the time spent in contact with the fuser roller 24. Thus, when the speed at which the sheets of media 14 are fed through the media feed path 12 is reduced, the time each sheet of media 14 spends in contact with the fuser roller 24 is increased, and the fusing temperature can be reduced while providing the same amount of energy for the fusing process properly to occur. Lowering the temperature of the fuser assembly 20 avoids temperature extremes for the fuser assembly 20 when printing narrow media.

However, lowering the fusing temperature and accompanying sheet feeding speed for all sheets of media 14 severely reduces throughput of the printer 10. Hence, in the printer of the present invention, only selected sheets of media 14 are printed at the reduced sheet feeding speed, so that throughput of the printer 10 is greater than the case in which all the sheets of media 14 are printed at the reduced sheet feeding speed.

It was found that a single threshold was not sufficient to implement the desired control of the temperature of the fuser assembly 20. A pair of thresholds, on the other hand, provided an adequate hysteresis. With a single threshold, intermixing different categories of media width resulted in the printer 10 repeatedly switching between the normal sheet feeding speed and the reduced sheet feeding speed. It will be recognized that substantial amounts of time are required to change from one printing speed to another, so that numerous speed changes in rapid succession severely reduce the throughput of printer 10. The upper threshold (Step S108) was selected so that the precision of the value of the meltometer was maximized without using large amounts of the available memory. The lower threshold (Step S134) was set some distance below the upper threshold to provide an appropriate hysteresis.

Many different reduced speeds can be selected to feed the sheets of media 14 through the printer 10. However, the engine controller 68 must adjust all the speed-related parameters for the printer 10 for each speed selected. These parameters include, for example, gamma correction, laser duty cycle, laser power, and developer voltage. This is very complicated for many different speeds. Since the memory space available in the flash memory 72 for storing the associated parameters is limited, it has not been found to be practical to have a large number of different sheet feeding speeds implemented in the printer 10. One solution is to limit the different sheet feeding speeds to a small number. In the preferred embodiment, a single speed of about one-half the normal sheet feeding speed was selected as the reduced sheet feeding speed.

It is to be appreciated that additional advantages accrue from the selection of a single reduced sheet feeding speed of one-half the normal sheet feeding speed. Video processing for each writing line is comparatively simple for a speed of one-half normal sheet feeding speed. Gamma correction, laser duty cycle, laser power, and developer voltage are also relatively simply handled.

Different methods of video processing in the printer 10 can be utilized for one-half normal sheet feeding speed. One method of video processing is to reduce the printhead scanning motor velocity so that each writing line of an image to be printed on a sheet of media 14 will take twice as long as at normal sheet feeding speed. A second method of video processing is to interlace a blank scan with each information-bearing scan during printing. This is sometimes called "skip-a-scan" or "scan-skipping"operation.

The skip-a-scan operation of the printer 10 can be implemented by different methods. According to one method, the raster image processor 62 alternately supplies the blank scans with the information-bearing scans. According to a second method, the engine controller 68 prints a blank scan by not asking the raster image processor 62 for an information-bearing scan. According to a third method, the control signal for sync pulses for the laser beam 34 is delayed for one cycle, corresponding to one facet of the polygonal mirror 36. In the preferred embodiment, the engine controller 68 skipped a scan of one facet of the polygonal mirror 36 during the reduced sheet feeding speed operation by delaying the sync pulses for the laser beam 34.

An additional advantage of skip-a-scan operation is that video switching times remain unchanged between the reduced sheet feeding speed and the normal sheet feeding speed, since the printhead scanning motor can operate at the same velocity as at normal sheet feeding speed. A second advantage of skip-a-scan operation is that unique parameters for gamma correction, laser duty cycle, laser power, and developer voltage are not necessarily required.

In operation, whenever any sheet of media 14 is printed, the computer program of FIG. 5 adds a value associated with the width category of the media to the meltometer (Steps S112, S120, and S126). The value of the meltometer is then compared to a pair of thresholds (Steps S108 and S134). The result of the comparisons determines whether over-temperature compensation of the fuser assembly 20 is invoked, if not currently active (Step S130), or ceased, if currently active (Step S136).

Categories of media width that have a tendency to increase the temperature of the fuser assembly 20 are assigned positive weighting factors (Steps S112, S120, and S126). Positive weighting factors are determined for each category of media width by:

$$\text{WeightingFactor}=\frac{\text{UpperThreshold}}{\text{NumSheetsAllowedBeforeCompensationNeeded}}$$

Categories of media width that have a tendency to reduce the temperature of the fuser assembly 20 are assigned negative weighting factors (Steps S112, S120, and S126). Negative weighting factors are determined for each category of media width by:

$$\text{WeightingFactor}=\frac{\text{UpperThreshold}-\text{LowerThreshold}}{\text{NumSheetsAllowedBeforeCompensationNeeded}}$$

In some special printing situations, it is advantageous immediately to invoke the reduced sheet feeding speed in order to prevent the fuser assembly 20 from reaching a high temperature. For these specific instances, the reduced sheet feeding speed is invoked when the sheets of media 14 are picked from the tray 16, 28. An example of a special printing situation in which the reduced sheet feeding speed is immediately invoked is the printing of an envelope on a belt-type fuser. Envelopes printed by such a belt-type fuser also require the reduced speed in order to provide sufficient energy to fuse properly.

It is to be appreciated that the value of the meltometer is not involved in selecting the reduced sheet feeding speed in special printing situations. However, the present invention does recognize that over-temperature compensation may be appropriate for special printing situations. In the preferred embodiment, if the value of the meltometer exceeds the upper threshold (Step S108) while the reduced sheet feeding speed is invoked, thus indicating that over-temperature compensation is appropriate, an inter-sheet gap is inserted in the printing of the sheets of media 14 to prevent overheating of the fuser assembly 20.

Since the computer program can invoke different over-temperature compensation methods to reduce the temperature of the fuser assembly 20, e.g. Employing a reduced sheet feeding speed or inserting an inter-sheet gap between consecutive sheets of media 14, once an over-temperature method is invoked, it remains in operation until the program determines that over-temperature compensation is no longer required.

If the value of the meltometer is below the lower threshold value (Step S134), over-temperature compensation is eliminated, and normal sheet feeding operation is resumed.

If the printing of the sheets of media 14 is paused, and the temperature of the fuser assembly 20 drops below a reset temperature, the computer program resets the value of the meltometer to an initial, minimal value.

For purposes of exemplification, particular embodiments of the invention have been shown and described according to the best present understanding thereof. However, it will be apparent that various changes and modifications in the arrangement and construction of the parts thereof may be made without departing from the spirit and scope of the invention as defined in the appended claims.

What is claimed is:

1. A printer comprising:

a media feed path for feeding sheets of media through said printer;

a media transport mechanism for feeding said sheets of media at a standard speed and at a reduced speed along said media feed path;

a media fixing mechanism for fixing toned images on said sheets of media at a standard temperature and at a reduced temperature;

a media transport initiating mechanism for initiating feed of sheets of media at a standard gap and at an increased gap;

means for detecting narrow media and for generating a narrow media signal when sheets of narrow media are fed through said media feed path;

means for counting narrow media and for generating a signal representing the sheets of narrow media that have been fed through said printer; and a controller responsive to said narrow media detection means detecting media of a predefined category of narrow media for adjusting said media transport mechanism to feed sheets of said category at reduced speed and for adjusting said media fixing mechanism to fix at said reduced temperature, while said media transport initiating mechanism initiates sheet feed at said standard gap, until said counting means reaches a predetermined amount representing repetitive feeding of narrow media, said control also then adjusting said media fixing mechanism to initiate sheet feed at said increased gap.

2. The printer as in claim 1 in which said predefined category is envelopes.

3. The printer as in claim 2 in which said media fixing mechanism is a belt fuser.

4. The mechanism as in claim 2 in which said sheets are fed with side registration through said media fixing mechanism.

5. The printer as in claim 1 in which said media fixing mechanism is a belt fuser.

6. The mechanism as in claim 5 in which said sheets are fed with side registration through said media fixing mechanism.

7. The mechanism as in claim 1 in which said sheets are fed with side registration through said media fixing mechanism.

8. The mechanism as in claim 7 in which said sheets are fed with side registration through said media fixing mechanism.

* * * * *